US005411442A

United States Patent [19]

Stephens et al.

[11] Patent Number: 5,411,442

[45] Date of Patent: May 2, 1995

[54] BOWLING ALLEY MASKING UNIT

[75] Inventors: Michael W. Stephens; William M. Riley, both of Richmond; Robert L. Morin, Glen Allen; Steven A. Bumbera, Richmond, all of Va.

[73] Assignee: AMF Bowling, Inc., Mechanicsville, Va.

[21] Appl. No.: 266,653

[22] Filed: Jun. 28, 1994

[51] Int. Cl.[6] ..... A63D 5/04

[52] U.S. Cl. ..... 473/54; 473/115

[58] Field of Search ..... 473/54, 64, 65, 73, 473/115; 160/98, 99, 100, 120, 121.1, 133, 238, 239, 240, 245, 313, 903

[56] References Cited

U.S. PATENT DOCUMENTS 930,233 8/1909 Rose .
2,530,462 11/1950 Gwin .
3,807,732 4/1974 Congelli .
5,076,582 12/1991 Edwards .

*Primary Examiner*—V. Millin
*Assistant Examiner*—William M. Pierce
*Attorney, Agent, or Firm*—Bacon & Thomas

[57] ABSTRACT

An easily changeable bowling alley masking unit provides a visual barrier that covers a forward portion of a pin spotter in a first position and provides ready access to that portion of the pin spotting mechanism when in a second position. The unit includes a generally rectangular frame, a cartridge adjacent to the frame and a pair of rollers disposed within the cartridge. The unit also includes a pair of masking members with one of the masking members attached to each of the rollers. Each of the masking members includes a display of one side thereof and is adapted to be rolled upon a roller for storage within the cartridge and unrolled to cover a portion of the pin spotter.

7 Claims, 4 Drawing Sheets

BOWLING ALLEY MASKING UNIT

FIELD OF THE INVENTION

This invention relates to a bowling alley which includes a readily changeable masking unit and more particularly to a masking cartridge and frame assembly which provides a visual barrier that covers or hides a forward portion of a bowling alley pin spotting mechanism when in a first position and which provides ready access to the pin spotting mechanism when in a second position.

BACKGROUND FOR THE INVENTION

The primary function of a bowling alley masking unit is to provide a visual barrier that hides or screens a forward portion of the pin spotting mechanism from a bowler's view. A second function is to provide decorative graphics. Such graphics are used to expand on a bowling center's color theme, and to depict various art scenes which contribute to the attractiveness of the center. And at times, the masking units are used to communicate messages such as "Join Fall League, Now!" or the like.

In today's competitive environment, bowling proprietors recognize that color graphics provide the most visual impact for their investment dollar. It has also been recognized that changing the color graphics is a cost effective way to update or refurbish an entire bowling center. Accordingly, it is presently believed that there is a strong commercial demand for an improved bowling alley masking unit which would facilitate such changes.

The problems associated with conventional masking units make it difficult for a bowling alley proprietor to make a major change in color theme or graphics since such masking units dominate the visual impact of the center. For example, many of the conventional masking units were not designed to facilitate changes. Such units are generally relatively large and cumbersome which makes it difficult to remove and/or replace the units. In fact, some of the earlier units were not designed to be replaced. Other units are large and cumbersome, difficult to handle without damaging the unit and require significant room for storage. And finally, the costs for shipping these large flat scenes are relatively high since they are shipped as oversize packages.

There is one other problem associated with conventional masking units, The problem is that such units do not provide ready access to the pin spotting mechanism for routine maintenance or service. Accordingly, the rigid masks are typically hinged along their upper edge or mid point and are rotated upwardly to provide limited access to the pin spotter.

It has now been found that a bowling alley masking unit in accordance with the present invention enables a bowling alley proprietor to more easily and inexpensively make significant changes in a bowling center's decor at a relatively low cost, with a minimal amount of effort and in a relatively short time. The reason for this is that the new masking units have been designed for such changes and incorporate a flexible mask that can be rolled up for storage or for access to the pin spotting mechanism and unrolled and held tightly in place for display purposes. These new units have been designed for scene changes, rapid removal and replacement without handling a cumbersome panel. In fact such units can be stored in a cartridge at the top of a frame or removed therefrom for insertion of a new mask with a different display. The masks are also easily and quickly moved into a storage position which allows better access to the pin spotting mechanism for service or maintenance, and then returned to the display mode when the maintenance work is completed.

In addition, the masking units in accordance with the present invention are relatively inexpensive to manufacture, durable, readily shipped and stored and almost maintenance free. And finally, the masking units allow the bowling proprietor to change the color scheme of a bowling center on relatively short notice at a relatively low cost without the need for skilled technicians.

BRIEF SUMMARY OF THE INVENTION

In essence, the present invention contemplates a bowling alley which has a longitudinally extending lane with two sides, an approach section, an intermediate lane section and a foul line disposed at one end of the lane between the approach and the intermediate lane sections. The lane also includes a pin deck for receiving a plurality of bowling pins thereon disposed at the opposite end of the alley and a pair of elongated concave gutters extending along and substantially abutting the sides of the lane between the ends thereof. The gutters are provided for receiving a bowling ball which falls off of the lane. Means for returning spent bowling balls to a bowler and a pin spotting mechanism disposed above the pin deck for delivering bowling pins to the pin deck in a predetermined pattern are also provided. The improvement comprises an easily changeable bowling alley masking unit which provides a visual barrier that covers a forward portion of the pin spotting mechanism when in a first position and which provides ready access to the pin spotting mechanism when in a second position. The masking unit includes a generally rectangular frame having a pair of generally vertical and parallel guide members spaced apart by a distance which is about equal to the width of the bowling alley. The unit also includes a cross member disposed at the top of the guide member and cooperating therewith to form a three sided frame and may include a bottom cross member. The guide members each include means defining a vertical channel and clamping means disposed within the channel. Roller means are disposed within or adjacent to the frame and a generally rectangular flexible masking member having a first side with a display thereon is fixed along one edge thereof to the roller means and is adapted to be rolled up on the roller means. The masking member has a pair of side edges disposed in the channel means and held in place therein by the clamping means. The masking member also includes a forward edge which extends beyond the roller means when the flexible masking member is in its extended position. A releasable latch means which may, for example, engage the bottom cross member, is also provided for maintaining the masking member in its extended position. In addition, means for returning the masking member to its first position upon release of the latch means may include a spring structure of the type commonly found in conventional window shades.

The invention also contemplates a bowling center of the type having a plurality of side by side bowling alleys and a plurality of masking units adjacent to the alleys. The masking units each includes a roller and a flexible masking member which is fixed along one edge thereof to the roller. Each of the masking members include a portion of an overall display and are disposed in a side by side array. The generally rectangular masking members are rolled up on the roller for storage and unrolled in a generally vertical plane to show a portion of display. A second roller and second masking member are preferably included in a cartridge with the first roller at the top of the masking unit. The second masking member includes a portion of a different display so that the overall theme of the center can be readily changed by rolling up each portion of a first display and replacing it with the multiple portions of the second display.

DETAILED DESCRIPTION OF THE PREFERRED EMBODIMENT OF THE INVENTION

Figure 1:
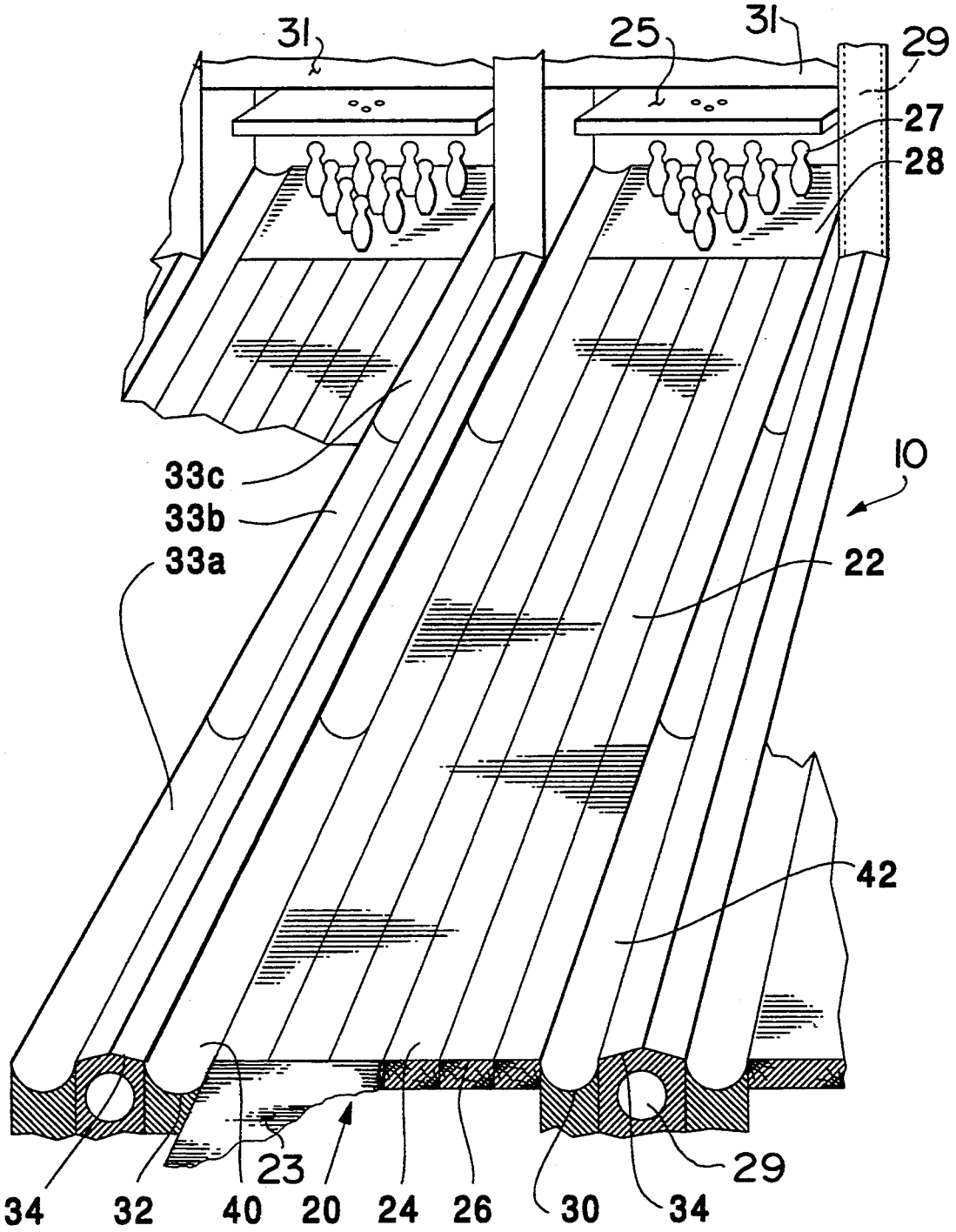
FIG. 1 is a perspective view of a bowling alley wherein a masking unit is illustrated in an elevated position to show a schematic representation of the forward portion of the pin spotting mechanism.

The invention will now be described in connection with the accompanying drawings wherein like reference numerals have been used to designate like parts.

As illustrated in FIG. 1, a bowling alley 10 typically includes a longitudinally extending lane 20 which defines a flat horizontal plane on an upper surface thereof and which is typically made up of a plurality of parallel abutting strips of wood 22, 24. In many of today's installations, the abutting strips have been replaced by a laminated panel. The alley includes a foul line 26 which extends across the lane 20 and perpendicular to the longitudinal axis of the lane. The foul line 26 indicates that area beyond which a bowler may not pass in releasing a bowling ball during a game of bowling. The area in front of the foul line is referred to as the approach section 23. A pin deck 28 is disposed at the opposite end of the lane 20 and is adapted to receive a plurality of bowling pins 27 thereon. As shown, the bowling alley is set with the pins in a customary triangular pattern with one pin, the head pin in front, a second row of two pins, a third row with three pins and a final of four pins. A pin spotting mechanism or pin spotter 25 is disposed above the pin deck 28 in a customary manner.

A pair of longitudinally extending gutters 30, 32 are disposed along the side of the lane 20 with one gutter on each side of lane 20 in a customary manner, i.e., adjacent to and in substantially abutting relationship with the lane. The gutters 30, 32 are adapted to receive any balls that are bowled toward one side of the lane and to direct any misdirected balls to the end of the alley. Also illustrated are capping members 34 which separate the adjacent alleys or lanes.

The conventional pin spotter or unit 25 (shown schematically) may be of any suitable design. One such design is disclosed in the U.S. Pat. No. of Congelli, 3,807,732, which is incorporated herein in its entirety by reference. A more recent example of a suitable pin spotting mechanism is the AMF model 82–90 which is available from AMF Bowling, Inc. of Mechanicsville, Va.

The bowling alley in accordance with a preferred embodiment of this invention also includes a conventional ball return 29 (shown schematically). The ball return may, for example, take the form shown in the U.S. Pat. No. 5,076,582 of Edwards, entitled "Bowling Ball Lifting Apparatus". That patent is assigned to the same assignee as the present application and is incorporated herein in its entirety by reference.

Figure 2:
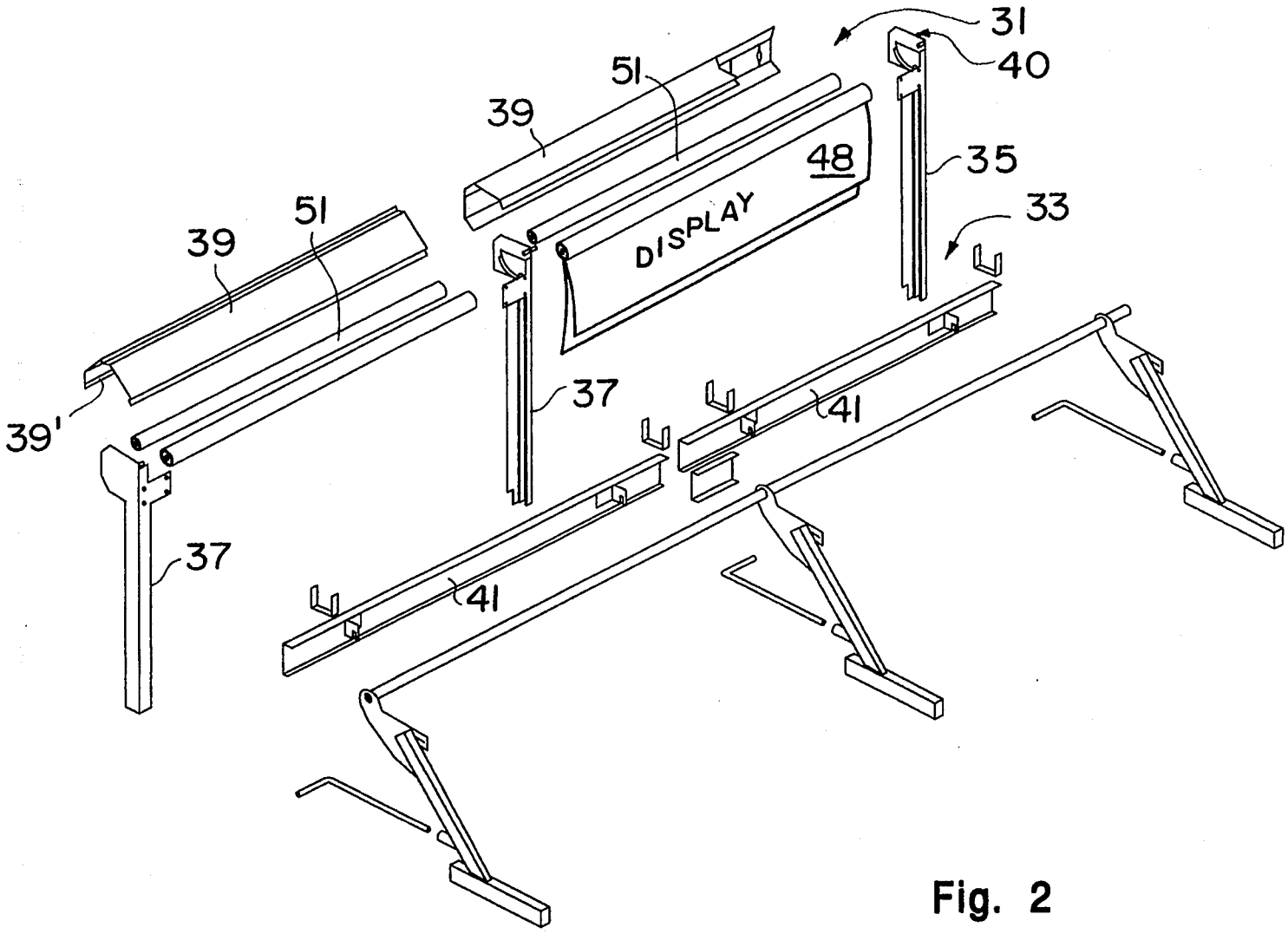
FIG. 2 is an exploded perspective view of a masking unit in accordance with a preferred embodiment of the present invention.
Figure 3:
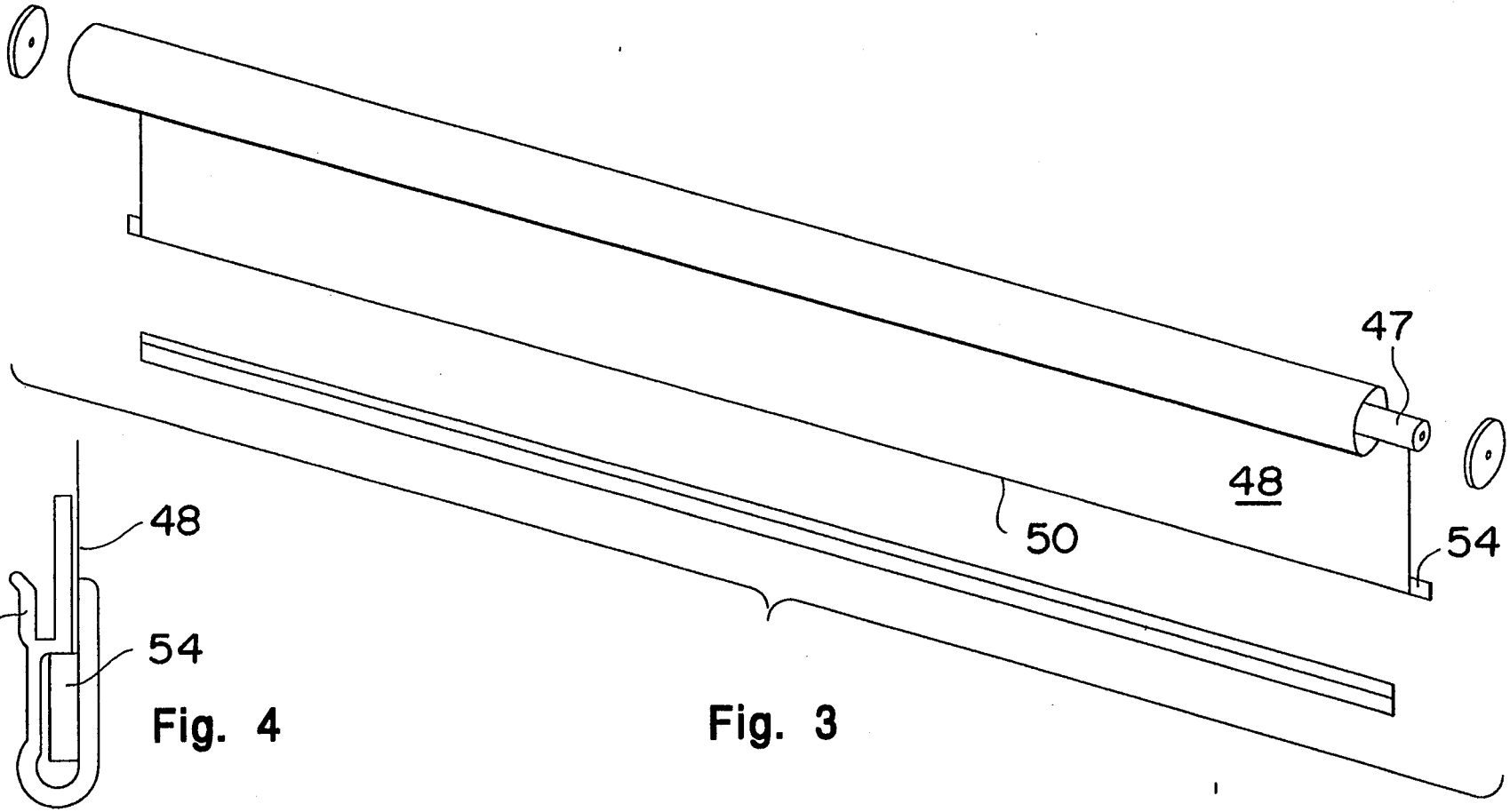
FIG. 3 is a perspective view of the flexible mask which is partially unrolled and with the bearings and cross bar shown in exploded perspective.
Figure 4:
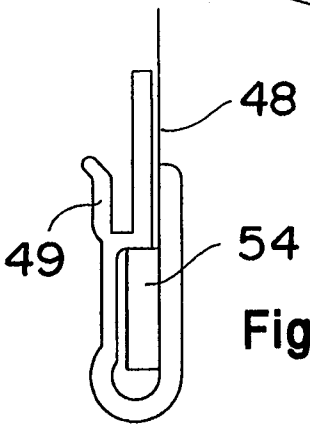
FIG. 4 is a side elevational view of a latch for securing the flexible mask in an extended position.
Figure 5:
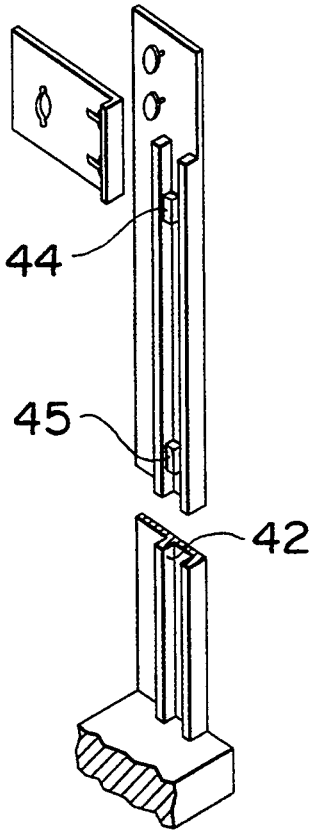
FIG. 5 is a perspective view of a channel means and clamping means of the type used in a preferred embodiment of the invention; and, FIG. 6 is a cross sectional view of a roller spring assembly of the type used in a preferred embodiment of the invention.

A masking unit 31 is also shown schematically in FIG. 1 in a position which is generally above its normal position in order to illustrate the forward portion of the pin spotter 25. The details of the masking unit are shown more clearly in FIGS. 2–6. As shown therein, a bowling alley masking unit 31 provides a visual barrier that covers a forward portion of a pin spotter 25 (FIG. 1) when in a first or extended position. The masking unit 31 also provides ready access to the pin spotter 25 when in a second or rolled up position. As shown in FIG. 2, the masking unit 31 includes a generally rectangular frame 40 having a pair of generally vertical and parallel guide members 35 and 37.

The guide members 35 and 37 are spaced apart by a distance which is about equal to the width of the bowling alley, i.e., the width of the lane 20 and gutters 30 and 32. A first cross member 39 which may define a cartridge 39' is preferably disposed at the top of and perpendicular to the guide members 35 and 37 and connected thereto to form the upper part of frame 40. A second cross member 41 or base member is generally parallel to the first cross member 39 and is removably connected to guide members 35 and 37 to form the bottom portion of the frame 40. Each of the guide members 35 and 37 include means defining a vertical C-shaped channel 42 and which is adapted to receive an edge of a flexible mask as will be described below. Clamping means such as spring biasing members 44 and 45 (see FIG. 5) are disposed within the channels.

Means such as a spring actuated roller 47 is disposed within the cartridge 39' or forms a part thereof. For example, the first cross member 39 may comprise an outer frame which holds roller 47 in place so that the roller is within cartridge 39' at the top of the frame 33. The frame 40 is also adapted to hold a second roller 51 in a ready mode, as illustrated in FIG. 2. Accordingly, an operator can unroll either depending on the desired display. The frame may hold additional cartridges for replacement of those which are in the ready mode.

A generally rectangular flexible masking member 48 having a first side with a display thereon is disposed on the roller 47 and attached thereto along one edge thereof so that it can be rolled up onto roller 47 and unrolled therefrom. The member 48 also includes a pair of side edges disposed in the channel 42 and 43 and held in place therein by clamping means or spring biasing members 44 and 45. A forward edge 50 of member 48 extends beyond the roller 47 when the flexible masking member 48 is in its extended position. The flexible member 48, a polyester laminate, should be somewhat stiff so that when it is extended between the guide members 35 and 37, it is held tightly and will not ripple or move in a manner that could distract a bowler. A support 54 is attached to the leading edge 50 to minimize the likelihood of damaging the member 48 when it is extended and also adds structural integrity to the member 48 so that it does not move after it is put in place in its extended position. For example, it is desirable to minimize any movement of the member 48 due to circulating air currents since such movement could be distracting to a bowler.

A releasable latch 49 (see FIG. 4) maintains the masking member 48 in its extended position. For example, the latch 49 may engage a corresponding element (not shown) on the second cross member 41. In the preferred embodiment of the invention, means such as a spring shown in FIG. 6 returns the masking member 48 to its first position upon release of the latch 49.

Figure 6:
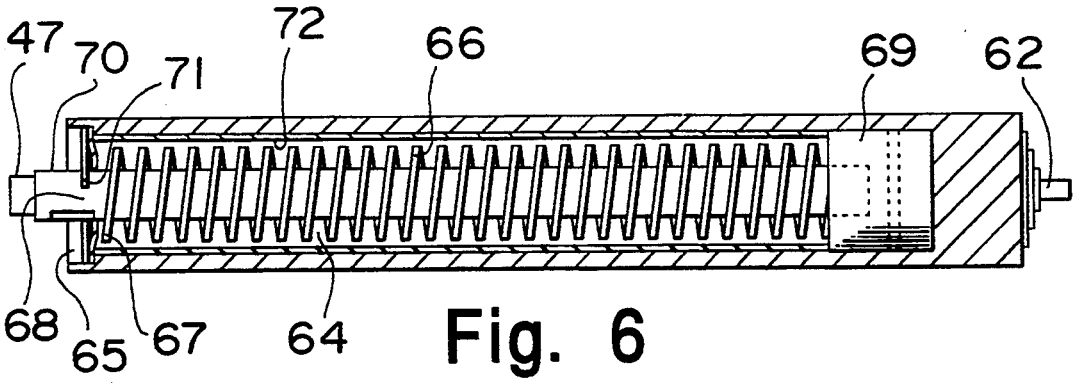

The roller 47 is generally similar to those which are disclosed in the U.S. Pat. Nos. of Rose, 930,233 and Gwin, 2,530,462 which are incorporated herein in their entirety by reference. The roller 47, as shown in FIG. 6, comprises a cylindrical chamber 64 which defines an opening at one end 65 thereof. The roller 47 also includes a shaft and bearing assembly 62 at its opposite end 63. The cylindrical chamber 64 is adapted to receive a spiral spring 66, one end 67 of which is attached to a spindle 68. The spindle 68 is journaled within roller 47 and the other end to a block 69. The spindle 68 extends beyond the end 65 of the roller 47 forming a conventional bearing 70 for insertion in a supporting bracket (not shown). Pawls 71 engage recesses in the spindle 68 when the spring 66 is contracted by unrolling member 48.

As illustrated in FIG. 6, the spring 66 is provided with an initial torsion, as described in the aforementioned patent of Rose, to counter balance the weight of member 48 before it is inserted into roller 47. This contracted state is maintained by a cylindrical metal case 72 which has an interior diameter which is essentially equal to the diameter of the contracted spring and with the case 72 inserted into the chamber 64. The case 72 is also provided with longitudinal ribs (not shown) to contact the wall of the chamber 64.

While the invention has been described in connection with its preferred embodiment, it should be recognized that changes and modifications can be made therein without departing from the scope of the claims.

What is claimed is:

1. In a bowling alley of the type having a longitudinally extending lane having two sides, an approach section, an intermediate lane section and a foul line disposed at one end of said lane between the approach and the intermediate lane sections, and a pin deck for receiving a plurality of bowling pins thereon disposed at the opposite end of the alley, a pair of elongated concave gutters extending along and substantially abutting the sides of said lane between the ends thereof for receiving a bowling ball which falls off of the lane, means for returning spent bowling balls to a bowler and a pin spotting mechanism disposed above the pin deck for delivering bowling pins to the pin deck in a predetermined pattern, the improvement comprising a bowling alley masking unit which provides a visual barrier that covers a forward portion of the pin spotting mechanism when in a first position and which provides ready access to the pin spotting mechanism when in a second position, said masking unit including a generally rectangular frame having a pair of generally vertical and parallel guide members spaced apart by a distance which is about equal to the width of the bowling alley, a first cross member cooperating with said guide members to form a three sided frame, a generally horizontal cartridge adjacent to one of said cross members and said guide members each including means defining a vertical channel and clamping means disposed within said channel, roller means disposed within said cartridge and a generally rectangular flexible masking member having a first side with a display thereon, said masking member disposed on said roller means and attached thereto along one edge thereof and having a pair of side edges disposed in said channel means and held in place therein by said clamping means, and a forward edge of said masking member extending beyond said roller means when said flexible masking member is in its extended position, releasable latch means for maintaining said masking member in its extended position and means for returning said masking member to its first position upon release of said latch means.

2. A bowling alley according to claim 1 in which the improvement further comprises a cartridge means having a storage area therein and a second roller and a second masking member stored in said cartridge for providing a change of scenes when said first masking member is rolled up on said first roller.

3. A bowling alley according to claim 2 in which the improvement further comprises said cartridge means being disposed at the top of said frame.

4. A bowling alley according to claim 3 in which a lower of said cross members is removably connected to one of said guide members so that it can be removed for further access to said pin spotter for servicing thereof.

5. In a bowling center of the type having a plurality of side by side bowling alleys each of which has a longitudinally extending lane having two sides, an approach section, an intermediate lane section and a foul line disposed at one end of said lane between the approach and the intermediate lane sections, and a pin deck for receiving a plurality of bowling pins thereon disposed at the opposite end of the alley, a pair of elongated concave gutters extending along and substantially abutting the sides of said lane between the ends thereof for receiving a bowling ball which falls off of the lane, means for returning spent bowling balls to a bowler and a pin spotting mechanism disposed above the pin deck for delivering bowling pins to the pin deck in a predetermined pattern, the improvement comprising a visual display and a plurality of readily changeable masking units each of which contains a part of said display and each of said masking units providing a visual barrier that covers a forward position of one of said pin spotting mechanisms when in a first position and which provides ready access to said one of said pin spotting mechanism when in a second position, roller means disposed and a generally rectangular flexible masking member having a first side with a portion of a display thereon, said masking member disposed on said roller means and attached thereto along one edge thereof, and a forward edge of said masking member extending beyond said roller means when said flexible masking member is in its extended position, releasable latch means for maintaining said masking member in its extended position and means for returning said masking member to its first position upon release of said latch means.

6. In a bowling center in accordance with claim 5, the improvement further comprising a cartridge in each of said masking units which is adapted to receive a second roller means and a second rectangular flexible masking member in each of said cartridges for displaying a portion of a scene.

7. In a bowling center of the type having a plurality of side by side bowling alleys each of which has a longitudinally extending lane having two sides, an approach section, an intermediate lane section and a foul line disposed at one end of said lane between the approach and the intermediate lane sections, and a pin deck for receiving a plurality of bowling pins thereon disposed at the opposite end of the alley, a pair of elongated concave gutters extending along and substantially abutting the sides of said lane between the ends thereof for receiving a bowling ball which falls off of the lane, means for returning spent bowling balls to a bowler and a pin spotting mechanism disposed above the pin deck for delivering bowling pins to the pin deck in a predetermined pattern, the improvement comprising a visual display and a plurality of readily changeable masking units each of which contains a part of said display and each of said masking units providing a visual barrier that covers a forward position of one of said pin spotting mechanisms when in a first position and which provides ready access to said one of said pin spotting mechanism when in a second position, each of said masking units including a generally rectangular frame having a pair of generally vertical and parallel guide members spaced apart by a distance which is about equal to the width of the bowling alley and a pair of parallel cross members cooperating with said guide members to form said frame and a cartridge adjacent to and parallel to one of said cross members, said guide members in each of said masking units each including means defining a vertical channel and clamping means disposed within said channel, roller means disposed within each of said cartridges and a generally rectangular flexible masking member having a first side with a display thereon, said masking member disposed on said roller means and attached thereto along one edge thereof and having a pair of side edges disposed in said channel means and held in place therein by said clamping means, and a forward edge of said masking member extending beyond said roller means when said flexible masking member is in its extended position, releasable latch means for maintaining said masking member in its extended position and means for returning said masking member to its first position upon release of said latch means.

* * * * *